US010556654B2

(12) United States Patent
Cucchia

(10) Patent No.: US 10,556,654 B2
(45) Date of Patent: Feb. 11, 2020

(54) MASKS FOR UNDERWATER USES

(71) Applicant: OCEAN REEF INC., San Marcos, CA (US)

(72) Inventor: Gabriele Cucchia, Genoa (IT)

(73) Assignee: Ocean Reef Inc., San Marcos, CA (US)

( * ) Notice: Subject to any disclaimer, the term of this patent is extended or adjusted under 35 U.S.C. 154(b) by 649 days.

(21) Appl. No.: 15/286,205

(22) Filed: Oct. 5, 2016

(65) Prior Publication Data

US 2017/0096204 A1 Apr. 6, 2017

(30) Foreign Application Priority Data

Oct. 6, 2015 (IT) ..... 102015000058683

(51) Int. Cl.
*B63C 11/12* (2006.01)

(52) U.S. Cl.
CPC ..... *B63C 11/12* (2013.01); *B63C 2011/128* (2013.01)

(58) Field of Classification Search
CPC . A41D 13/1161; A41D 13/1184; A61F 9/027; A61F 9/029; A61F 9/045; A61M 16/06; A62B 18/00; A62B 18/02; A62B 18/08; A62B 18/082; A62B 18/10; A62B 27/00; A62B 7/04; A62B 9/02; A62B 9/022; A62B 9/025; B63C 11/12; B63C 11/14; B63C 11/16; B63C 11/186; B63C 11/205; B63C 11/26; B63C 2011/125; B63C 2011/128; B63C 2011/165;
(Continued)

(56) References Cited

U.S. PATENT DOCUMENTS 3,680,555 A * 8/1972 Warncke ..... A62B 18/02 128/201.15
4,276,877 A * 7/1981 Gdulla ..... A62B 18/00 128/200.27

(Continued)

FOREIGN PATENT DOCUMENTS

CN 204173146 U † 2/2015
CN 204173146 U † 2/2015

(Continued)

OTHER PUBLICATIONS

Search Report for Italian Appl. No. IO 59383 dated Jun. 14, 2016.

(Continued)

*Primary Examiner* — Annette Dixon
(74) *Attorney, Agent, or Firm* — The Maxham Firm; Lawrence A. Maxham

(57) ABSTRACT

A full face diving mask having a transparent visor (2), a frame or strapping (3), a sealing skirt (4) to ensure the water-tight seal, and suitable straps (5) for fitting the mask on the user's face. The mask has a breathing tube (6) which engages on the tipper part of the mask and which allows the flow of air to enter into the compartment made between the frame and the visor.
The breathing tube is made with separate ducts for the air inhaled and exhaled and the inside of the mask is made with two compartments, an upper main compartment (26) and a lower oronasal compartment (7) separated by a separating wall.

8 Claims, 6 Drawing Sheets

(58) Field of Classification Search
CPC ..... G02C 3/02; H04B 11/00; H04M 1/05; H04N 5/2253; H04R 21/021; Y10T 137/7725; Y10T 137/783
See application file for complete search history.

(56) References Cited

U.S. PATENT DOCUMENTS

| | | | | | |
|---|---|---|---|---|---|
| 5,398,673 | A * | 3/1995 | Lambert | ..... | A61M 16/0048 128/201.11 |
| 2016/0297505 | A1* | 10/2016 | Caprice | ..... | B63C 11/16 |

FOREIGN PATENT DOCUMENTS

| | | | | | |
|---|---|---|---|---|---|
| CN | 204548450 | U † | 8/2015 | | |
| CN | 204548450 | U † | 8/2015 | | |
| EP | 1820728 | A2 * | 8/2007 | ..... | B63C 11/16 |
| FR | 2720050 | A1 * | 11/1995 | ..... | B63C 11/16 |
| FR | 2720050 | A1 | 11/1995 | | |
| WO | 2015170013 | A1 | 11/2015 | | |

OTHER PUBLICATIONS

Easy Free Breath Snorkeling Full Face etc., retrieved from www.youtube.com on Oct. 26, 2017, pp. 1-289.†
Thenice Snorkling, JD Publication, Thenice.JD.com retrieved Oct. 26, 2017, pp. 1-24.†
LC Prime Easy Free Breath Surface Snorkeling etc., Amazon.com, retrieved Oct. 25, 2017; pp. 1-13.†
The Nice Free Breath Snorkel Mask; www.youtube.com, retrieved Oct. 25, 2017; pp. 1-259.†

* cited by examiner
† cited by third party

MASKS FOR UNDERWATER USES

CROSS-REFERENCE TO RELATED APPLICATION(S)

This application claims priority under 35 U.S.C. § 119 from Italian Patent Application No. 102015000058683, filed on Oct. 6, 2015, in the Italian Patent and Trademark Office, the entire contents of which are incorporated herein by reference.

FIELD OF THE INVENTION

The present invention relates to a mask for underwater use, in particular of the full face type equipped with a mouthpiece so as to be able to breathe with the head under water.

DISCUSSION OF PRIOR ART

Masks for use underwater, also known as diving masks, comprise a part or frame made of rubber or silicone which adheres to the face of the user by means of at least one strap which wraps around the head of the user and at least a transparent part, generally made of glass or Plexiglas, designed to allow vision underwater and annul the refraction phenomenon which determines blurred vision underwater. The glass and the rubber frame isolate at least part from the underwater environment in a watertight manner allowing a correct vision.

Two types of mask are particularly widespread in diving activities: a first which covers eyes and nose, and a second called full face, which covers the entire face, mouth included. This second type of mask comprises a transparent visor, a frame or strapping, a sealing skirt made of rubber designed to ensure the watertight seal, and suitable straps for fitting the mask on the face. The face part of the mask is associated with breathing mouthpiece which engages on the upper part of the frame and which allows the flow of air to enter into the compartment made between the frame and the visor.

The paths of the air being inhaled and exhaled are advantageously different from each other.

For this purpose, two compartments are made inside the mask; an upper main compartment in the area of the eyes and cheekbones of the user and an oronasal compartment associated with the nose and mouth of the user. Said compartments are separated by a separating wall provided with valves for the air.

The fresh air inhaled reaches the main compartment of the mask through the tube, strikes the transparent part or visor, passes through the wall by means of the above-mentioned valves and reaches the oronasal compartment for breathing in.

The air exhaled from the mouth or from the nose does not escape from the oronasal compartment, because the valves on the separating wall prevent it, but reaches the tube along a perimetric exhalation duct of the mask.

The tube is made with separate ducts for the air inhaled and exhaled provided with suitable directional valves.

This avoids the known drawback of misting up of the mask, since only fresh air coming from the outside strikes the transparent part whilst the used air escapes from the mask without passing in the facial area of the mask.

A mask of this type is called "Easybreath" full face, marketed with the "Tribord" brand.

In this mask the exhalation duct is made partly by means of a channel made on the upper perimetric part of the strapping which surmounts the transparent part and which terminates on top toward the mouthpiece. The connection between said channel and the oronasal compartment is formed underneath using small tubes which run around the perimeter on the lower part of the strapping and which insert into the lower end of the channel.

This channel in the strapping is formed during moulding of the strapping by blowing a suitable hot gas in the area where said channel is to be made.

The Applicant has noted that this operation is complicated and tricky at the same time. Moreover, the connection between the channel and the small tubes may become not fully watertight, for example due to an impact, and allow a certain quantity of exhausted air to pass into the first compartment, thereby risking a misting up of the visor.

Also, when the mask is worn it adapts to the dimensions of the user's face; in this case, the small tubes can, depending on the dimensions of the face, become more or less compressed and allow a greater or lesser flow of air, which might be insufficient to guarantee correct breathing by the user.

SUMMARY OF EMBODIMENTS OF THE INVENTION

With the present invention the Applicant proposes an improvement of the system for circulation of air inside a full face type mask, which at the same time simplifies the making and the assembly.

BRIEF DESCRIPTION OF THE DRAWING

The features and advantages of a diving mask according to the present embodiments of the invention will more fully emerge from the description that follows, of a non-limiting example, referred to the accompanying schematic drawings in which.

DETAILED DESCRIPTION OF THE PREFERRED EMBODIMENTS

Figure 1:
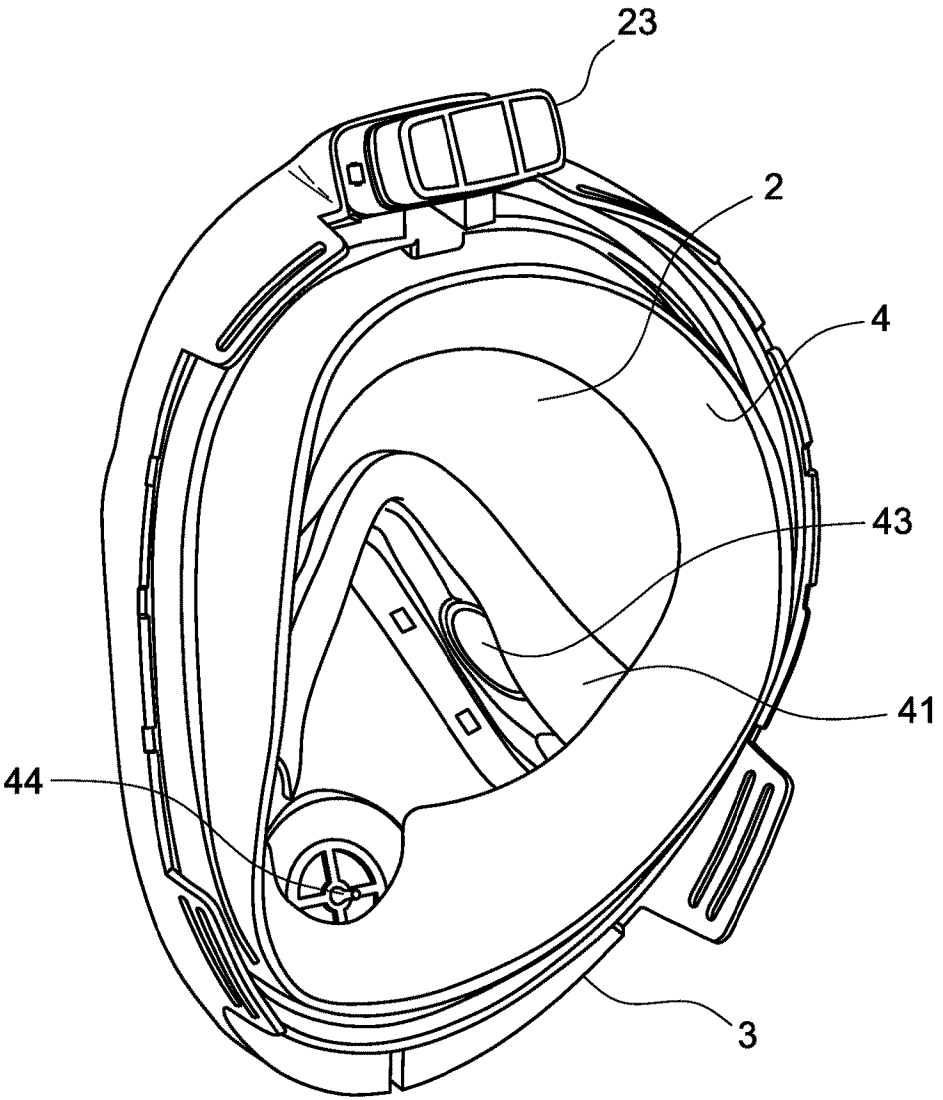
FIG. 1 is a perspective view of a mask according to an embodiment of the present invention without the tube and the fastening straps.

The above-mentioned figures show a diving mask of the so-called full face type which comprises a transparent visor 2, a frame or strapping 3, a sealing skirt 4, preferably made of rubber designed to ensure the water-tight seal, and suitable straps 5 for fitting the mask on the face.

The face part of the mask is associated with breathing tube 6 which engages on the upper part of the mask and which allows the flow of air to enter into the compartment made between the frame and the visor.

The path of the air being inhaled and exhaled both in the mask and in the breathing tube are advantageously different from each other.

For this purpose, the tube is made with separate ducts for the air inhaled and exhaled.

Figure 6:
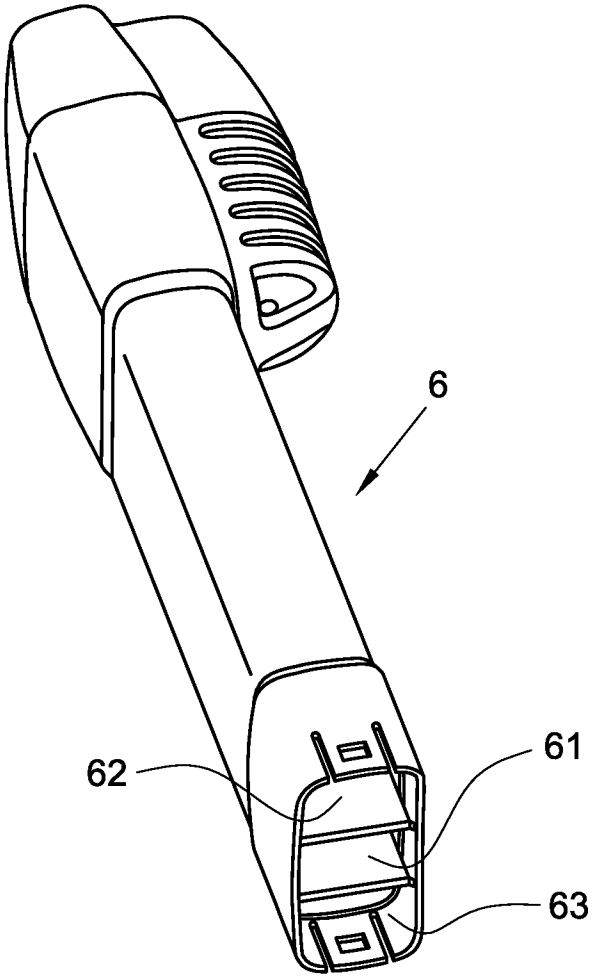
FIG. 6 is a perspective view of the tube of the mask of FIG. 1.

Preferably, the inhalation duct 61 (FIG. 6) is arranged in a central position and the exhalation ducts 62 and 63 are two arranged at the sides of the central inhalation duct.

Unidirectional valves (not illustrated), which allow air to pass only in the desired direction, are arranged substantially on the top of said ducts.

Figure 3:
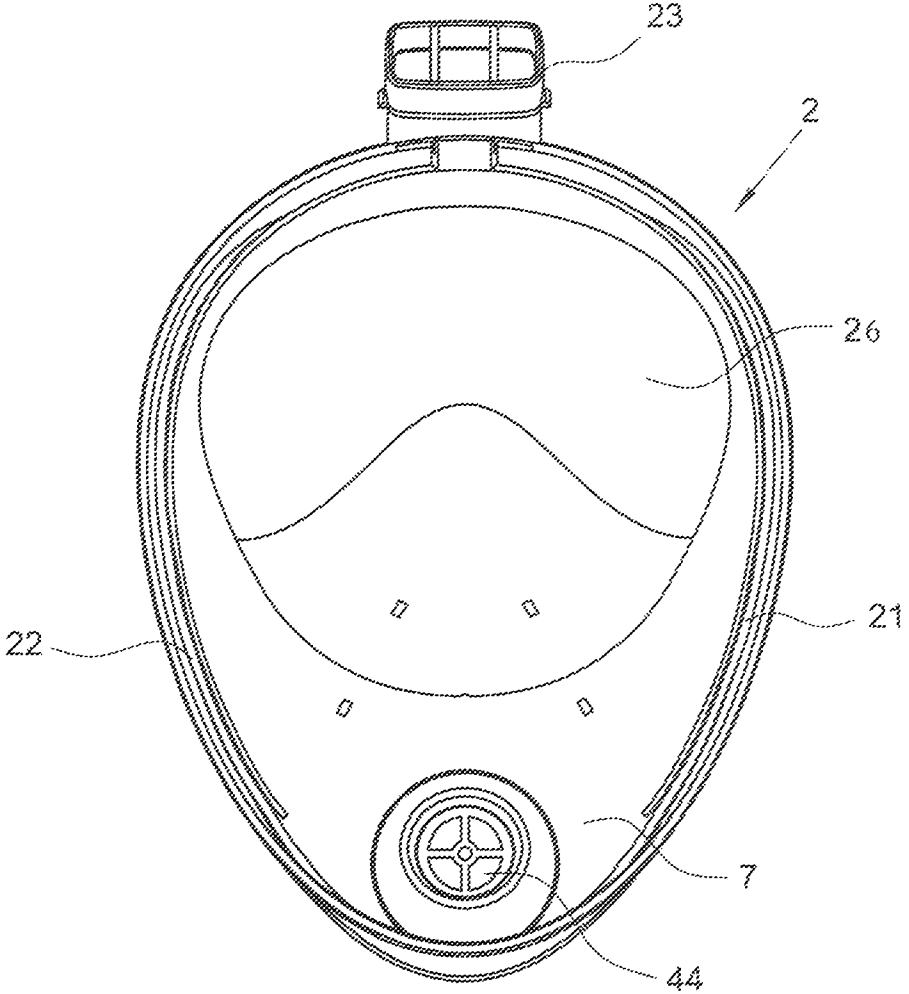
FIG. 3 is an elevational view of the visor of the mask of FIG. 1.
Figure 4:
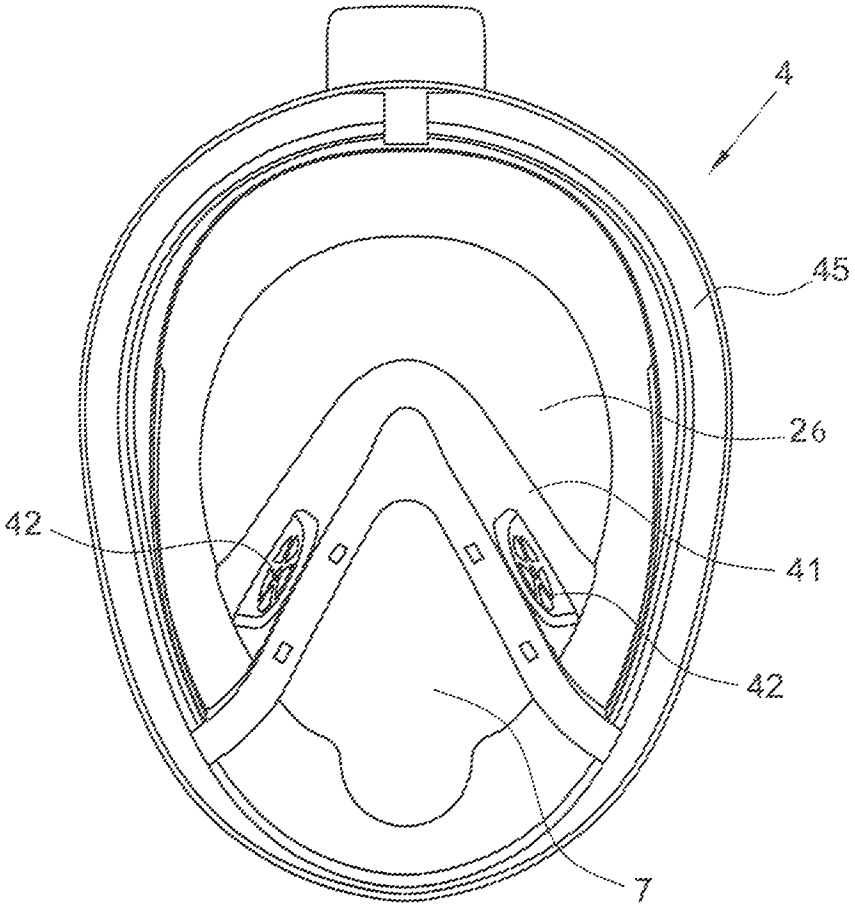
FIG. 4 is an elevational view of the seal of the mask of FIG. 1.
Figure 5:
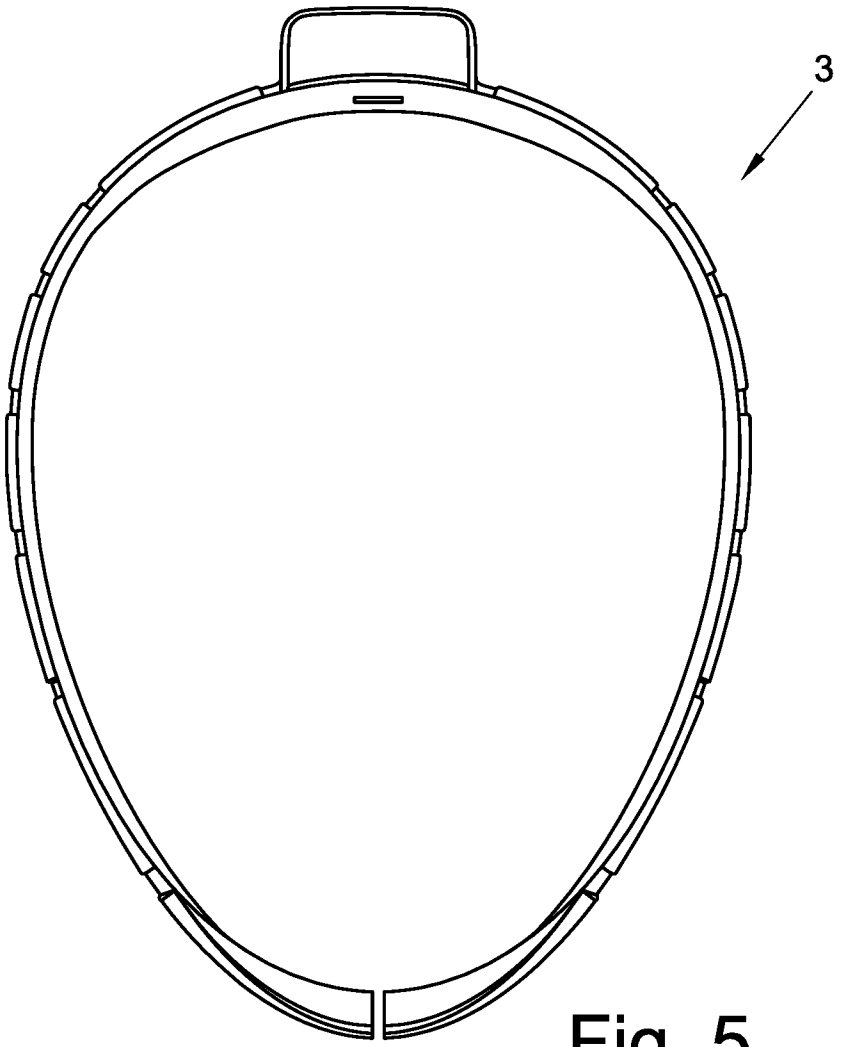
FIG. 5 is an elevational view of the frame or strapping of the mask of FIG. 1.

Again with the aim of creating differentiated paths inside the mask, two compartments are made, an upper main compartment 26, in the area of the eyes and cheekbones of the user, and an oronasal compartment 7 associated with the nose and mouth of the user as shown in FIGS. 3 and 4.

Figure 2:
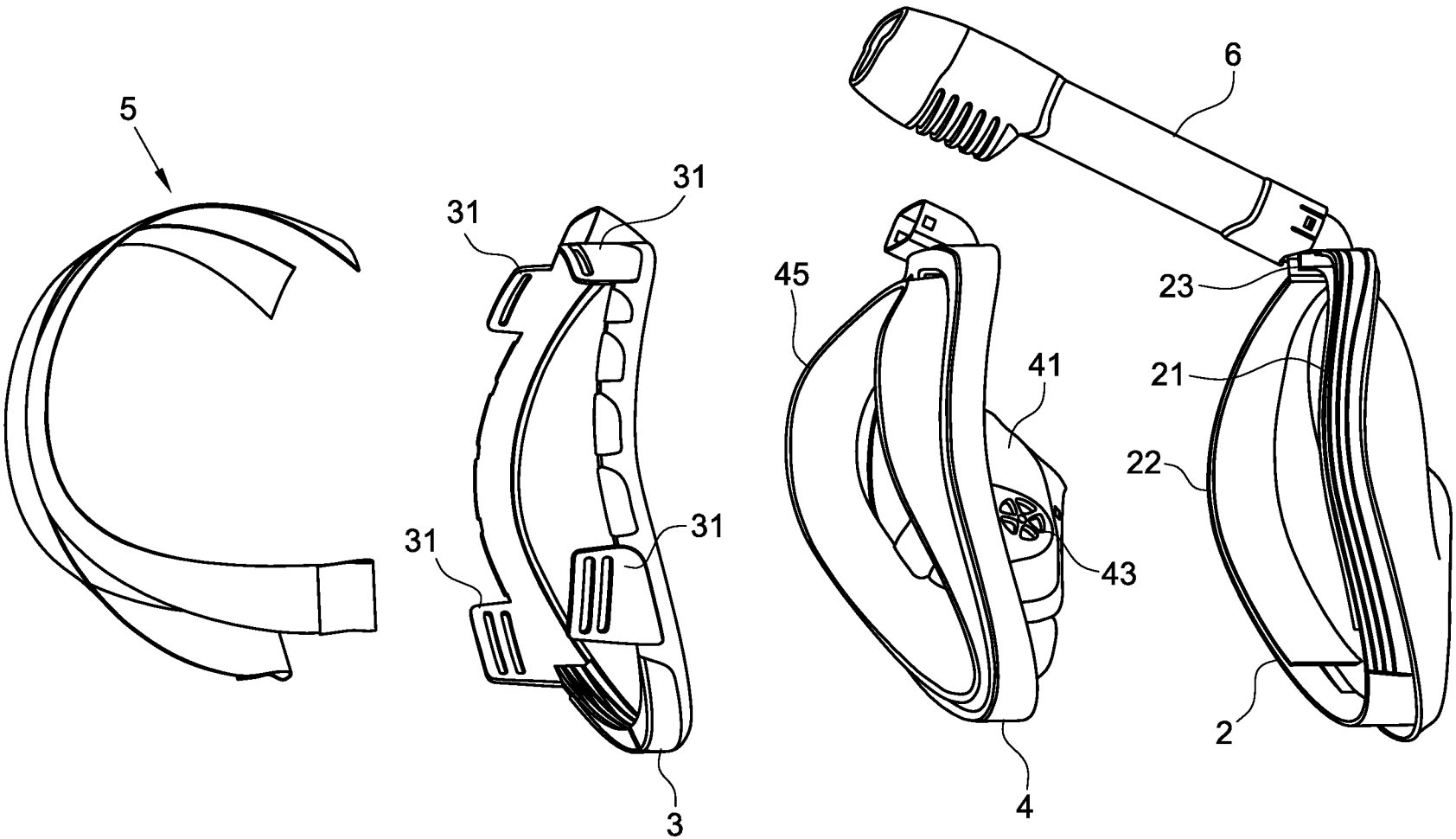
FIG. 2 is a perspective exploded view of the mask of FIG. 1.

As shown in FIGS. 2 and 4, these compartments are separated by a separating wall 41, made in association with the sealing skirt 4 and provided with at least one housing 42 for at least one unidirectional valve 43 for the passage of air from the main compartment to the oronasal compartment. Advantageously, there are two valves arranged laterally in a symmetrical position with respect to a vertical middle plane that passes through the mask.

The separating wall is fixed to the visor by suitable fixing means, preferably through clips.

A valve 44 is formed in the middle, lower portion of the oronasal compartment 7 for the release of liquid from the above-mentioned compartment if water has inadvertently penetrated inside the mask.

The fresh air inhaled reaches the main compartment of the mask through the tube, strikes the transparent part or visor, passes through the wall by means of the above-mentioned valves and reaches the oronasal compartment for breathing in.

The air exhaled from the mouth or from the nose does not escape from the oronasal compartment, because the valves on the separating wall prevent it, but reaches the tube according to the present invention along a perimetric exhalation path of the mask.

This path comprises a pair of perimetric channels 21 and 22 (FIGS. 2 and 3) formed on the edge of the visor which are preferably substantially U-shaped which, when the visor is associated with the sealing skirt, are closed by a flat annular edge 45 of the sealing skirt 4 forming as many perimetric ducts for the air exhaled. These channels extend from the top of the visor where there are means for coupling the mask with the tube made in the form of a housing 23 for the engagement of said tube, beyond the position wherein the separating wall 41 between the two compartments joins the visor itself. This is to prevent the exhalation ducts from communicating with the first compartment.

The means for coupling the mask to the tube also determine the coupling of the respective exhalation ducts of the tube and of the mask. The inhalation duct of the tube leads directly into the upper main compartment 26.

The channel formed in the visor and enclosed by the sealing skirt is a substantially non-deformable channel; this guarantees an optimum flow of the air exhaled under any condition and regardless of the size of the user's face.

Moreover, as seen in FIG. 2, both the channel and the coupling for the tube are formed in the visor; this determines an easy of construction of the strapping which becomes a simple ring provided only with clips 31 for the straps 5 which retain the mask assembly. The only complex element to be made in the mask remains the visor, which, however, may be moulded conventionally, thus avoiding the gas blowing procedure which was used in the prior art masks for making the channel in the sealing skirt.

The invention claimed is:

1. A diving mask comprising a transparent visor (2), a frame or strapping (3), a sealing skirt (4) adapted for ensuring a water-tight seal, and suitable straps (5) configured to fit the mask on a user's face, the mask being associated with a breathing tube (6) that engages on an upper part of the mask and that allows the air flow to enter into a compartment formed between the frame or strapping and the visor, the path of air being breathed in and that being breathed out both in the mask and in the breathing tube being different from each other, the breathing tube being made with an inhalation duct for the air breathed in which is separate from an exhalation duct for the air breathed out, the inside of the mask being made with two compartments, one main compartment (26) and one oronasal compartment (7), separated by a separating wall (41), the path inside the mask provides for the air breathed in to be introduced from the tube into the main compartment and then into the oronasal compartment and the air breathed out from the oronasal compartment travels on a perimetric path of the mask up to the breathing tube, the perimetric path comprises a pair of perimetric channels (21,22) that extend from the top of the visor (2) past the position in which the separating wall (41) between the two compartments joins up with the visor, said perimetric channels being formed in the visor on its periphery and being closed by a flat annular edge (45) of the sealing skirt (4) when the visor is associated with the sealing skirt forming perimetric ducts for the air breathed out, said perimetric channels extending from the top of the visor where there are coupling means of the mask with the tube made in the form of a housing (23) for the engagement of said tube, both perimetric channels (21, 22) and the coupling means for the tube being formed in the visor.

2. The mask according to claim 1, wherein the perimetric channels (21,22) are substantially U-shaped in cross section.

3. The mask according to claim 1, wherein the inhalation duct (61) is arranged in a central position and there are two exhalation ducts (62,63) arranged at the sides of the central inhalation duct.

4. The mask according to claim 3, wherein said ducts are configured to allow air to pass only in the desired direction.

5. The mask according to claim 1, wherein said separating wall (41) is provided with at least one housing (42) for at least one unidirectional valve (43) for the passage of air from the main compartment to the oronasal compartment.

6. The mask according to claim 5, wherein there are two valves on said wall arranged laterally in a symmetrical position with respect to a vertical middle plane that passes through the mask.

7. The mask according to claim 1, wherein the separating wall is fixed to the visor.

8. The mask according to claim 1, wherein in a lower portion of the oronasal compartment a valve (44) is formed for the release of liquid from the aforementioned compartment if water should have accidentally penetrated inside the mask.

* * * * *